United States Patent [19]

Kolvek et al.

[11] 4,452,749

[45] Jun. 5, 1984

[54] METHOD OF REPAIRING HOT REFRACTORY BRICK WALLS

[75] Inventors: Robert E. Kolvek, Ontario, Canada; Henry R. Bronke, Buffalo, N.Y.; Nicholas W. Foit, Jr., Hamburg, N.Y.; Robert J. Kish, Tonawanda, N.Y.

[73] Assignees: Modern Refractories Service Corp., N.Y.; National Steel Corp., Del.; Republic Steel Corp., N.J.

[21] Appl. No.: 417,983

[22] Filed: Sep. 14, 1982

[51] Int. Cl.[3] ..... F27D 1/16

[52] U.S. Cl. ..... 264/30; 202/270

[58] Field of Search ..... 264/30; 201/41; 202/267 R, 270

[56] References Cited

U.S. PATENT DOCUMENTS

| | | | |
|---|---|---|---|
| 2,611,330 | 9/1952 | Kirk . | |
| 2,851,760 | 9/1958 | Taylor . | |
| 2,879,051 | 3/1959 | Buckholdt . | |
| 3,413,385 | 11/1968 | Komac et al. . | |
| 4,017,960 | 4/1977 | Kawabe | 264/30 X |
| 4,077,848 | 3/1978 | Gainer et al. | 201/41 |
| 4,108,384 | 8/1978 | Egli | 239/665 |
| 4,189,457 | 2/1980 | Clement | 264/30 |
| 4,364,798 | 12/1982 | Costa | 264/30 X |

*Primary Examiner*—Thomas P. Pavelko

*Attorney, Agent, or Firm*—O'Neil and Bean

[57] ABSTRACT

A high temperature refractory brick wall is repaired by removing and replacing damaged brick while the wall is maintained at a temperature below normal operating temperature but sufficiently high to avoid damage from contraction resulting from cooling. New brick having a coefficient of thermal expansion compatible with the heated wall are used to avoid cracking of the wall due to expansion during heat-up. Workers wearing protective clothing, preferably incorporating a circulating fluid cooling system, remove the damaged brick and install new brick in their place in walls having surface temperatures of about 500° F. or higher and internal temperatures substantially above 500° F., preferably at least about 1500° F.

28 Claims, 7 Drawing Figures

FIG.2
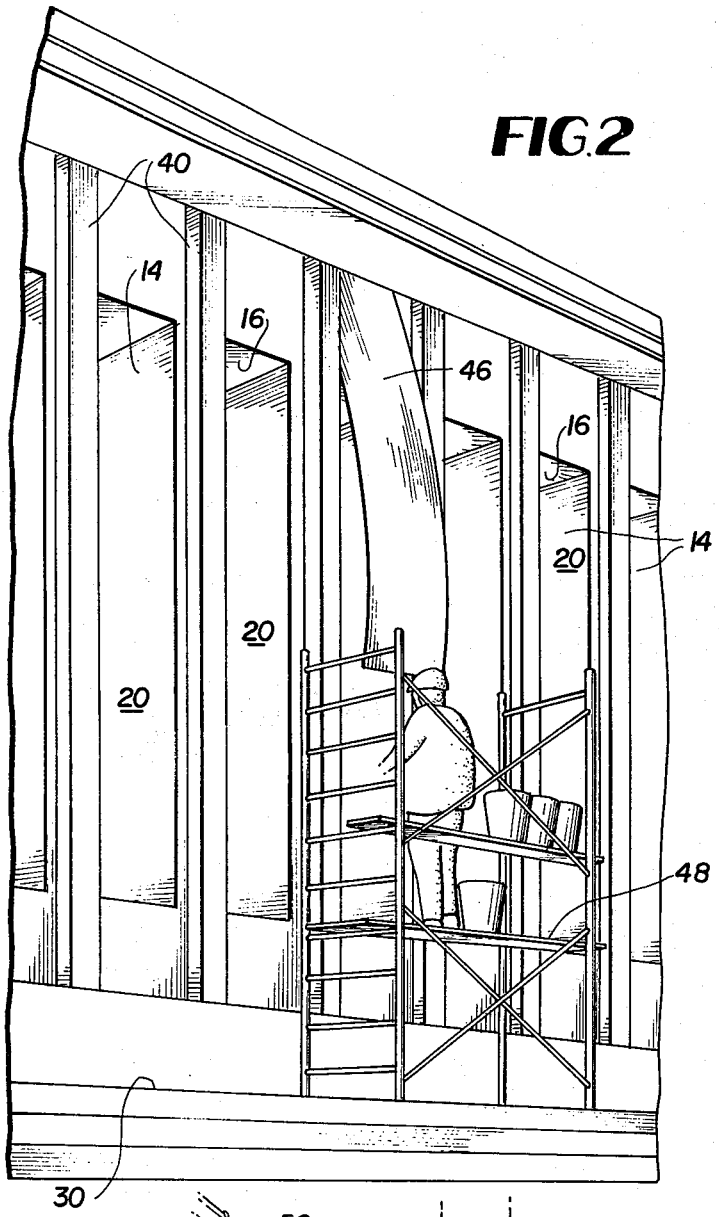
FIG.4
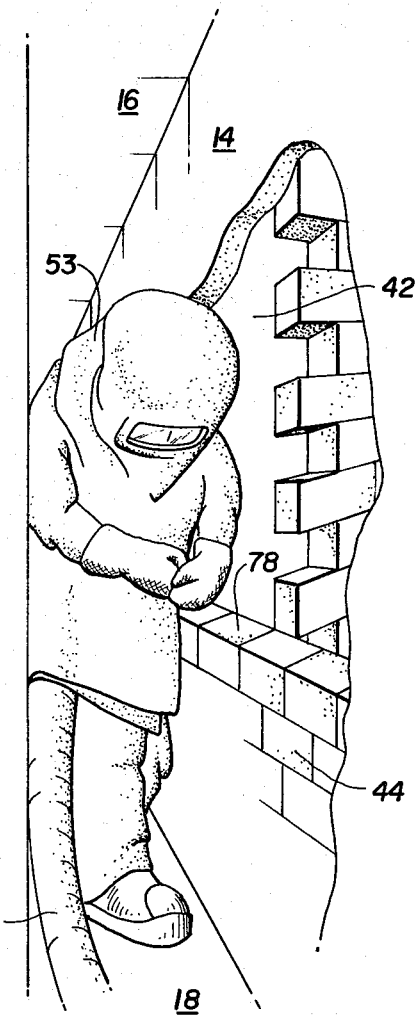
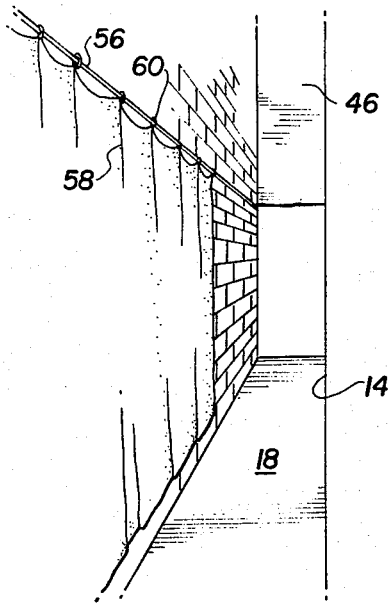
FIG.3

METHOD OF REPAIRING HOT REFRACTORY BRICK WALLS

BACKGROUND OF THE INVENTION

1. Field of the Invention

This invention relates to the repair of refractory brick walls used in high temperature installations, and more particularly to the repair of such walls by removing and replacing damaged brick without requiring cooling of the wall to ambient temperature.

2. Description of the Prior Art

Substnaital improvements have been made, and continue to be made, in refractory brick of the type employed in high temperature applications such as in industrial furnaces and coke ovens. As a result, the strength and resistance to thermal shock, and consequently the life expectancy of walls constructed from such brick, have been greatly increased. Nevertheless, maintenance and repair of such walls continues to present severe problems, both from the standpoint of making a satisfactory repair and from interruption of or interference with production during the repair.

The invention is particularly well adapted for repairing refractory brick liner walls of a coke oven and will be described herein with reference to coke oven repair; however, it should be understood that the invention may be employed in repairing other high temperature brick walls and is not limited to use in coke ovens.

Coke ovens are normally constructed of refractory silica brick which maintain relatively high strength even at the extreme temperatures encountered in the coking operation. Such ovens may have an overall life expectancy of 40 years or more, but may nevertheless require repair after only a few years of operation. Spalling of the refractory brick in the lining wall may commence for various reasons, including small cracks resulting, for example, from foundation settling, uneven expansion during heat-up or cool-down, air leaks, thermal shock and/or repeated thermal cycling during operation. The inclusion of foreign material in a coal charge can also produce "hot spots" which damage a local area. Once spalling has commenced, it can progress both to adjacent brick and more deeply into the wall until it interferes with pushing of the coke which, again, can produce more damage. Unless properly repaired, the damage can progress through the wall liner to the heating flues.

Since coke ovens are normally constructed in batteries each consiting of a large number of ovens extending in side-by-side relation with common walls between adjacent ovens, repair of an individual oven wall liner can not, from a practical standpoint, be accomplished by cooling only the oven needing repair since flues in the common wall are required to heat the adjacent ovens. Further, any attempt to cool one oven in a battery to a temperature that would enable workmen to enter and make repairs, even if adjacent ovens were partially cooled, would result in severe stresses due to shrinking and could cause substantial damage both to the oven being repaired and to adjacent ovens. Accordingly, it has long been the practice to repair coke oven liner walls by applying a temporary patch over the dampaged area using a gunning or spraying technique wherein refractory aggregate is applied either as a slurry or in a "dry" gunning mixture which is sprayed or thrown directly onto the hot oven wall. The difficulties encountered in applying such patching material are well-known to those skilled in the art and are generally discussed, for example, in U.S. Pat. No. 3,413,385. Particular difficulty is encountered in repairing oven liner walls by the gunning process in areas which can not conveniently be reached through an open door by repairmen, protected by a heat shield, standing outside the oven.

Although various techniques and procedures have been developed for repairing hot refractory walls utilizing a gunning process, the results have not been satisfactory and generally have produced only a temporary repair which must be repeated at frequent intervals. Further, the adverse conditions under which such repair material is applied makes complete control of the application virtually impossible; material sagging and overspray frequently occur, producing rough and uneven wall surfaces which can interfere with pushing and further shorten the life of the repair. Eventually damage progresses until it can not be repaired by gunning and it is necessary to shut down and replace the complete wall.

Particular difficulty is encountered in making repairs to coke oven walls where the damage has progressed through the wall liner into a flue in the oven wall. If only a small opening or crack has penetrated to the flue, repair can sometimes be effected by a gunning process, although some of the sprayed refractory material will frequently pass through the opening and drop into the flue. Larger openings, however, cannot be successfully repaired in this manner.

It is, accordingly, the primary object of the present invention to provide an improved method for repairing refractory brick walls.

Another object is to provide an improved method of effecting permanent repairs of coke oven wall liners without requiring adjacent ovens to be shut down.

Another object of the invention is to provide a method of repairing a coke oven wall liner by removing and replacing damaged brick while the wall is maintained at a temperature sufficiently high to avoid damage resulting from shrinkage.

Another object of the invention is to provide a method of repairing a hot refractory brick wall by removing and replacing damaged brick wherein workers wearing protective clothing work in ovens having an internal surface temperature of up to 500° F. or higher and internal temperatures substantially above 500° F.

In the attainment of the foregoing and other objects and advantages, an important feature of the present invention resides in making repairs to refractory brick walls of a coke oven chamber while maintaining the walls at a temperature sufficiently high to avoid damage resulting from cooling. To accomplish this, the oven doors are removed, leaving the oven open to the atmosphere for a period of about eight hours, or until the surface temperature of the brick wall liners reaches approximately 500° F. During this time, the heat in the flues in the walls on each side of the oven is reduced preferably to about 1500° F. Surprisingly, it has been discovered that silica refractory brick which have been used as oven liner walls for extended periods shrink very little with this reduction in temperature so that essentially no damage due to thermal contraction is encountered. By controlling the temperature in the flues inside the walls being repaired and in the adjacent ovens the surface temperature of the walls inside the oven chamber can be maintained at the desired level for a time sufficient to complete the necessary repairs.

When the oven to be repaired reaches the desired reduced temperature, workers wearing protective clothing enter the open oven chamber to remove the brick from the damaged section of the wall liner. This is accomplished by initially cutting around the damaged section, using a suitable saw preferably powered by compressed air, and with the saw cutting completely through the brick of the liner wall and into any flue chambers located behind the damaged area. After cutting around the damaged area, using only horizontal cuts along an original mortar line and vertical cuts extending along mortar lines where possible, the damaged brick are removed using suitable tools. In the vertical portions of the wall between adjacent flues, brick are carefully removed along mortar joints to enable replacement with new brick which will tie directly into the existing structure and the wall liner repair.

After the damaged brick are completely removed, any exposed flues are cleaned to remove any refractory material which may have fallen either during operation of the oven or during removal of the damaged area. Before starting the repair, fuel is blocked from the flues in the damage area; however, heat is applied at a reduced level to the wall through flues which will not be exposed through the removed wall sections.

After completely removing the damaged brick and cleaning the flues and repair area, the wall portion is rebuilt using brick having a coefficient of thermal expansion compatible with the wall at the temperature at which repair is made. Repair may be accomplished by workers carrying brick, having mortar applied from outside the oven and carefully reconstructing the removed portion of the wall. Upon completion of the repair, the oven can be closed and reheating commenced immediately to bring the coking chamber back up to operating temperature. When the desired temperature is reached, the oven may be charged and operated in the normal manner since the permanently installed repair has sufficient strength to withstand stresses of the normal coking operation.

Since the coking chamber of a regenerative coking oven is relatively narrow, working within the chamber necessarily entails considerable contact with the hot refractory brick wall which tends to quickly damage the protective clothing. In order to minimize such damage and to thereby provide an increased element of protection for the workers, a smooth surface tile may be applied to the inner surface of the liner wall in the undamaged areas before commencing the repair operation. The individual tiles may be relatively large and be adhesively bonded directly to the refractory brick wall surface. By applying adhesive outside the oven, the tiles can be carried into the oven and installed very quickly. The tile and adhesive are able to withstand the reduced temperature of the oven but are consumed during a coking operation so that contamination of coke by tile which are left in place at the completion of the repair operation is avoided. Alternatively, a heat insulating curtain may be suspended along the wall surfaces as from a cable passed through the oven, with the curtain and cable being removed at the completion of the repair operation.

BRIEF DESCRIPTION OF THE DRAWINGS

The foregoing and other objects and advantages of the invention will be apparent from the detailed description contained hereinbelow, taken in conjunction with the drawings, in which:

FIG. 2 is a perspective view of a portion of the coke side of the oven battery shown in FIG. 1 and showing workmen in front of an open oven;

FIG. 3 is a fragmentary perspective view through the open coke oven of FIG. 2 and showing a protective heat shield curtain installed along one wall thereof;

FIG. 4 is a fragmentary perspective view showing a workman wearing protective clothing working in the open oven;

DESCRIPTION OF THE PREFERRED EMBODIMENT

Figure 1:
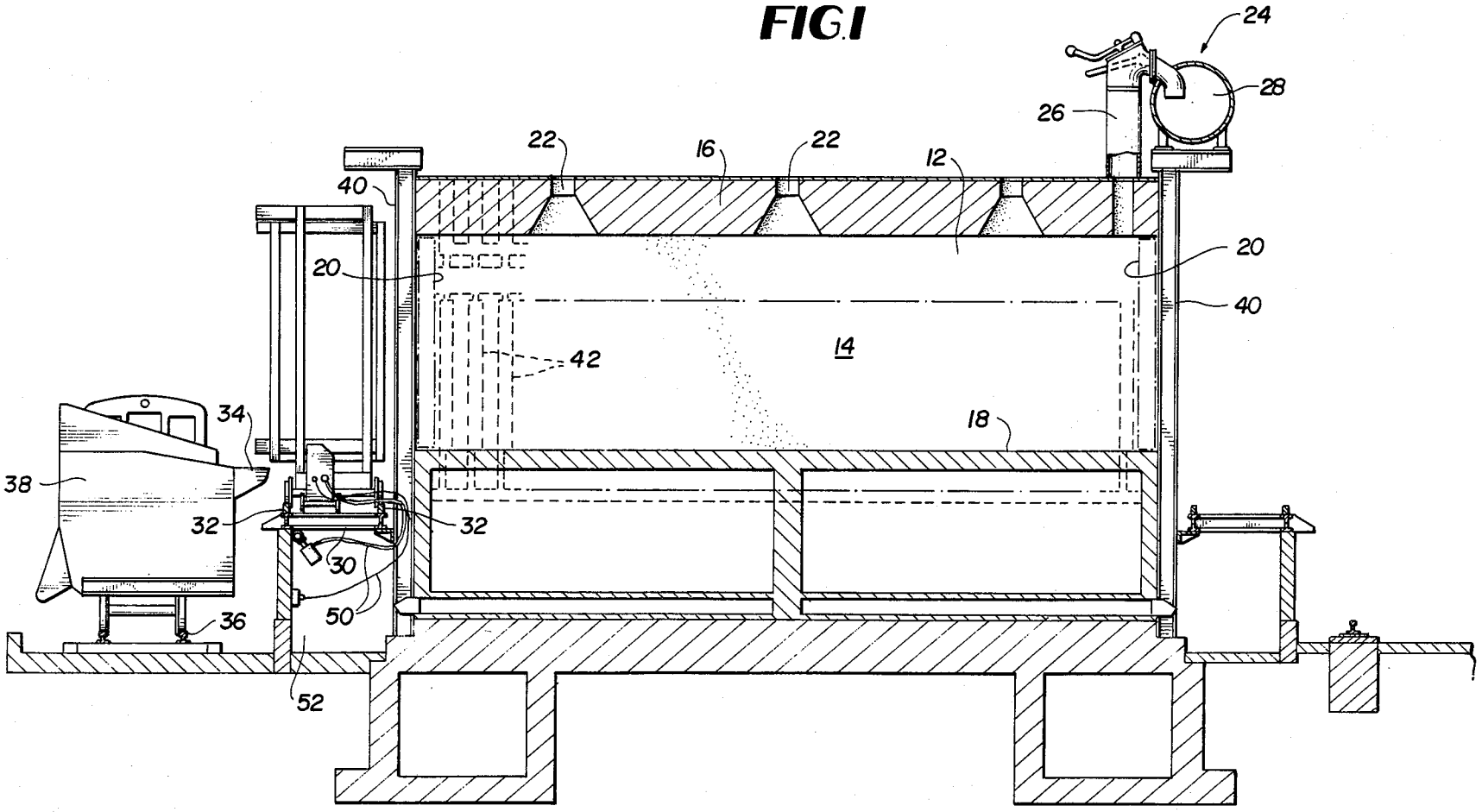
FIG. 1 is a schematic vertical sectional view through a coke oven battery.

The improved method of the present invention is particularly well adpated for use in the maintenance of by-product type coke oven batteries of the type schematically illustrated in FIG. 1 and designated generally by the reference numeral 10. As is known, such coke oven batteries conventionally comprise a plurality of coking chambers 12 constructed in side-by-side relation transversely of the longitudinal axis of the battery, with a common refractory brick wall 14 separating each pair of adjacent coking chambers. A refractory top wall and floor 18 complete the generally rectangular, elongated chamber which is closed at its respective ends by removable doors 20. Charging holes 22 in top wall 16 permit a charge of coal to be deposited into the respective chambers. A conventional aspiration system 24, including ascention pipe 26 and collecting main 28, is provided at the charging end of the battery for removing distillation products generated in the chamber during the coking process.

Such batteries also conventionally include a coke guide bench 30 having rails or tracks 32 mounted thereon extending along the full length of the coke side of the battery at a level below the floor 18. Two coke guides 34 and two door machines, not shown, are supported in the tracks 32 for movement along the battery at a level above a second parallel set of rails 36 which support a quench car 38 in position to receive hot coke pushed through a coke guide from an oven chamber. Structural steel buckstays 40 extend vertically along the end of each wall 14 at each end of the oven for providing structural reinforcement in the convention manner.

In operation of coke ovens of this type, the temperature of the refractory structure is normally maintained at a level in excess of 2000° F. by supplying fuel gas and heated combustion air to a plurality of flues 42 extending in parallel spaced relation in the walls 14. The course of refractory brick 44 defining the inner surface of walls 14 and separating the coking chamber from the heating flues is generally referred to herein as the liner wall, it being understood that the liner wall and the wall structure separates the heating flues are constructed from the same type of brick, normally a refractory silica brick.

As previously mentioned, the inner surface of the liner wall may become damaged after extended use at the extreme temperatures encountered in a coking operation. A spall or area of damage to the liner wall may become evidenced in various ways. For example, difficulty may be encountered in pushing a cake of hot coke from an oven, or the spall may be visible through the open doors following pushing, particularly in the areas adjacent the ends of the oven which are more clearly visible through the open doors. A more thorough inspection may be required to detect spalls, particularly small ones, in the liner walls away from the door areas.

When it is determined that an oven requires repair, in accordance with the present invention preparation for the repair is preferably commenced the day before the actual repair is effected. The preparation involves pushing, charging and banking the two adjacent ovens and pushing and closing but not charging the oven to be repaired. The temperature of the walls 14 to be repaired is then reduced by reducing the flow of fuel gas to the flues in those walls until the flue temperature is within the range of about 1500° F. to about 1900° F. This flue temperature is maintained until the wall surface temperature in the empty oven reaches approximately 500° F.

When the oven walls reach the desired reduced temperature, the oven doors 20 are removed and a heat curtain, indicated schematically at 46 in FIG. 2, is placed in front of the door openings to avoid excess escape of heat and to protect workmen in the areas of the open door. A working platform indicated schematically at 48 in FIG. 2, is then positioned on bench 30 in front of the open door to support workers and materials at the level of the oven floor 18. Preferably the work platform is supported on wheels for movement along the coke guide rails 32, particularly if more than one oven in the battery requires repair. However, as indicated, a stationary, temporary scaffold may be erected on the bench adjacent the open door of the oven. Compressed air, water and electrical power may be suppled to the working platform through lines indicated generally at 50 from the tunnel area 52 beneath bench 30 through the regenerator inspection door opening (not shown) to allow the coke side door machines and guide cars to operate on either side of the oven being repaired.

Prior to commencing the actual repair, the supply of fuel gas and air to the flues immediately behind the area to be repaired is shut off. Throughout the repair operation, however, heat is supplied to the remaining flues to assure against the temperature of the oven walls dropping below a minimum critical temperature below which substantial thermal contraction of the refractory brick commences to take place. It has been found that when the temperature in the flues is maintained at at least about 1500° F. and the liner wall surface temperature is not permitted to drop below about 500° F. the silica brick shrink only a negligable amount and no damage due to shrinkage occurs in the time required to repair an oven.

Workmen wearing a special hot suit 63 in the form of heat insulating protective clothing enter the oven from the working platform to make repairs. Since the coking chamber 12 is very narrow, direct contact with the wall surfaces cannot be avoided. These wall surfaces are relatively rough and abrasive to the protective clothing, particularly after extended use, and since the surface temperature of the wall is maintained at a minimum of about 500° F., it is preferred to initially provide a protective barrier for the workers along the wall surface. This has been accomplished in two methods, the preferred being illustrated in FIG. 5 wherein relatively large, smooth-surfaced, heat insulating tiles 54 are adhesively bonded directly to the exposed surface of the walls 14. Insulating tiles 54 which are 3 foot square and approximately ¼ inch thick have been successfully employed and can be quickly appled by the workmen carrying the individual tiles from the platform into the oven and pressing them into position. Preferably, an adhesive material is applied to one surface of the tile by other workmen on the work platform outside the oven.

The tiles 54 and the adhesive material readily withstand the 500° surface temperature of the oven wall, but are constructed of a material which will be consumed by the more intense heat encountered during a coking operation so that the tiles may be left in place following completion of the repair and simply be burned off prior to or during the first coking cycle following repair.

In an alternate procedure, illustrated in FIG. 3, a pair of stainless steel cables 56 may be passed through the open oven by the coke pushing machine ram, then secured under tension to the buckstays 40 outside the oven door at each end of the oven chamber. Heat insulating blankets 58 may then be hung as by hooks 60 on the cables 56 to cover the walls in the areas not requiring repair. In addition to protecting the workers' protective clothing from abrsion by the hot walls, the heat insulating curtain 58, or insulating tiles 54 help to retain heat in the wall and guard against damage from excessive cooling at the surface of the refractory brick. If desired, only the wall on one side of the oven chamber may be covered.

Figure 5:
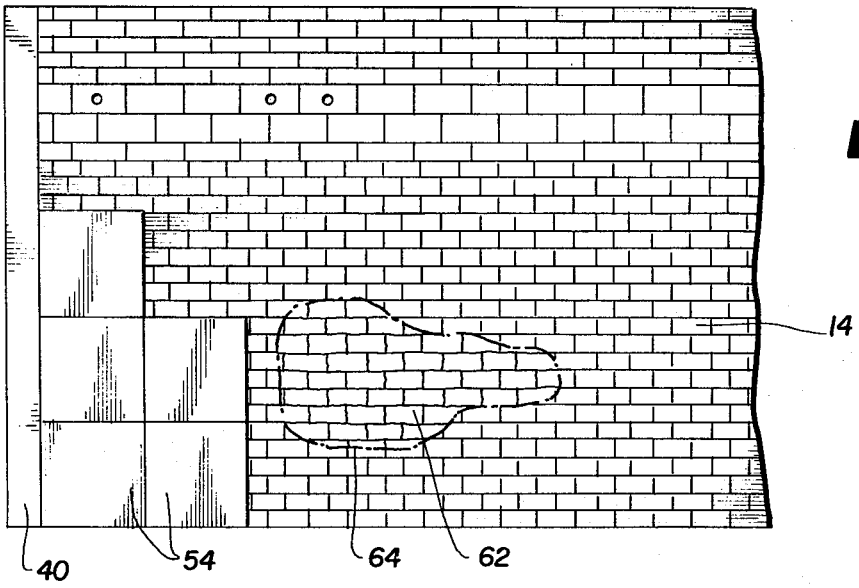
FIG. 5 is a fragmentary elevation view of a coke oven wall showing a damaged area outlined in broken line and showing a number of heat insulating tile mounted on a portion of the damaged wall.
Figure 6:
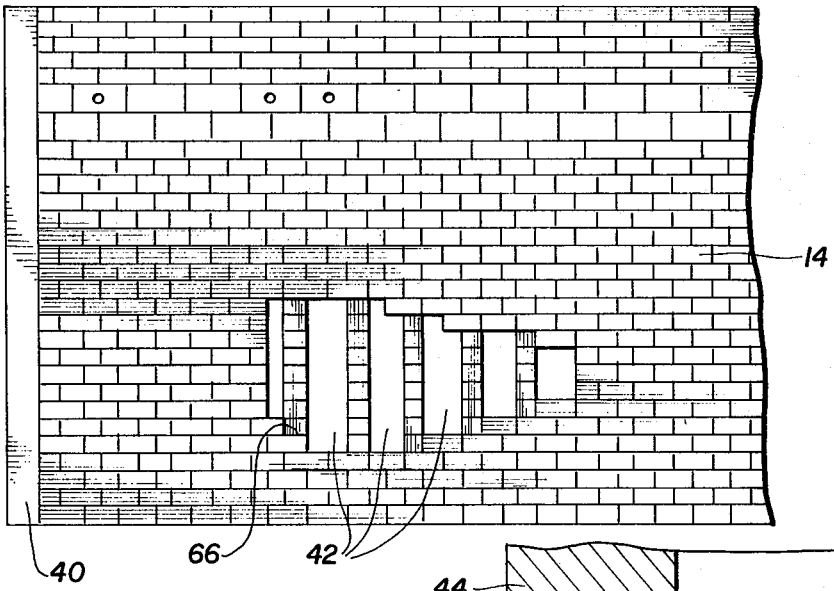
FIG. 6 is a view similar to FIG. 5 and showing the damaged area removed.

Referring now to FIGS. 5 and 6, a damaged, or spalled area 62 of wall 14 is generally outlined with the broken line 64. Repair is commenced by a workman removing the damaged brick in this area, using suitable power tools. Because of the limited working area, lightweight pneumatic tools which can be manipulated with one hand are preferred. The initial step in removing the damaged brick consists of sawing or cutting completely through the liner wall into the heating flues behing the damaged area, preferably using an air driven, water cooled brick saw having a diamond blade which may be 14 inches in diameter. Horizontal and vertical cuts only are used with the bottom horizontal cut preferably following a mortar line in the original brick and vertical cuts following a mortar line where possible. The top horizontal cut or cuts may be made just slightly below a mortar line for reasons pointed out hereinbelow.

After cutting through the wall substantially completely around the spalled area, the damaged brick are removed by use of a pneumatic chipping hammer and suitable hand tools, as required. As is known, however, the liner wall is integrally tied with the brickwork dividing the flues within the wall, and the brick tying into the flue divider wall portions are carefully removed so that new brick can be inserted in their place to maintain the original structural integrity in the repaired wall.

After all damaged brick have been removed and the old mortar cleaned from the exposed surfaces around the opening indicated at 66 in FIG. 6, the exposed flues in the wall 14 are cleaned to remove all debris. The opening in the wall is then carefully rebuilt using brick of the same size and configuration as the brick removed. The new brick, however, are molded from a castable refractory material described more fully hereinbelow. High temperature mortar is applied to the individual brick by workmen on the platform 48 outside the oven.

These brick, with the mortar applied, are then carried by workmen in the special hot suit 53 and carefully fitted into the opening, building the wall and typing the new wall into the divider wall portions separating the flues 42 to completely rebuild the wall opening.

Figure 7:
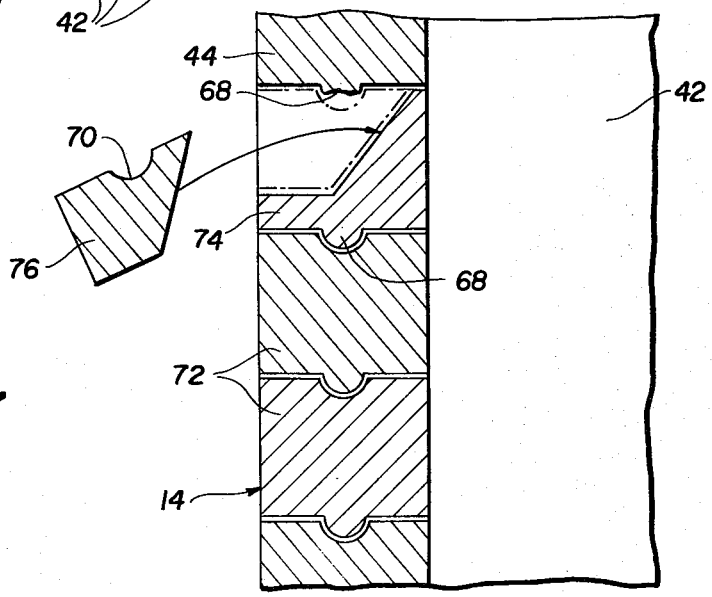
FIG. 7 is an enlarged sectional view showing new brick being installed in the area were damaged brick were removed.

As indicated in FIG. 7, silica brick 44 normally used in constructing the coke oven liner walls 14 are formed with tongues 68 and grooves 70 to interlock adjacent brick and thereby strengthen the wall so that the mortar joint alone is not required to carry lateral loads encountered, for example, during pushing or charging an oven. Preferably, in removing the damaged brick, the saw kerf formed along the top of the opening 66 is spaced slightly below a mortar line and the remaining portion of the cut brick and mortar removed by a chipping hammer to leave the tongue 68 in place along the course of brick defining the top of the opening. This enables all the newly laid cast brick 72 to be tied with a tongue and groove joint to the existing brick 44 in the original wall with the exception of the final brick to be positioned in the opening. The final brick opening may be filled in two cast blocks 74 and 76 shaped so that block 74 may be inserted with its tongue 68 fitted into the groove 70 of the cast brick 72, with block 76 then being inserted to take advantage of the strength to be gained by the tongue and groove structure. If desired, however, a portion of the tongue 68 of the existing brickwork may be removed to facilitate placing the final block 76 in the opening.

Promptly upon completion of the repair, the heat shield 46, curtain 52, and supporting cables 50, if they were installed, are removed and the doors 20 are replaced. The temperature in the flues of the walls 14 on each side of the oven is then increased to bring the oven temperature back up to that required for coking coal. This reheating may be accomplished within about 4 hours following completion of the repair without damage either to the original brickwork of the oven or to the newly installed cast brick used in the repair. As soon as the coking chamber is reheated, it may be charged and a new coking cycle commenced, with the new brickwork having sufficient strength to withstand the stresses of charging and of pushing at the end of the coking cycle which may be 24 hours after charging.

As indicated previously, the temperature of the walls 14 should not be allowed to drop below about 500° at their surface, or the temperature in the flues to drop below about 1500° F. during the repair operation. Below these temperatures, thermal contraction increases and substantial damage to the wall stucture can result. However, shrinkage of the silica brick material employed to form the liner walls shrinkd relatively little when cooling from the relatively high temperature encountered in a coking operation to the temperatures maintained in repairing the wall in accordance with the present invention.

The brick employed in the repair are molded from a castable refractory material which does not expand, or which expands only to a negligible degree, during heat-up from ambient temperature to operating temperature of the coking oven. Accordingly, the repair brick can be rapidly heated without fear of expansion of these brick producing excess stresses and damage either to themselves or to surrounding existing wall structure. However, since the castable material contains substantial silica material, operation of the repaired wall at coking temperatures for substantial periods results in the cast brick acquiring substantially identical expansion properties with the original silica brick employed to construct the oven. Thus, if it becomes necessary to cool the oven to ambient temperature, the brick used to make the repair will contract at essentially the same rate as the remainder of the wall so that again excessive stresses are avoided. Such castable refractory material is commercially available and as such forms no part of the present invention.

In an alternate embodiment of the invention which has been used, although somewhat less expediently, silica brick of the type originally employed in the wall were used to make the repair. In order to avoid problems resulting from differential expansion in this arrangement, it was necessary to initially heat the brick to a temperature generally corresponding to the temperatures encountered during a coking operation and to subsequently cool the brick to about 1000°–1100° F. The brick were maintained at this temperature until they were installed. This was accomplished by keeping the brick in a heated chamber until just prior to use at which time they were removed and mortar applied then carried into the oven and placed using specially designed hot brick handling tongues.

Although it is contemplated that various heat protective clothing might be used in the practice of this invention, two hot suits developed by Modern Refractories Service Corporation have been found to be particularly well adapted for this use. One such suit incorporates an inner garment which is water cooled and an outer suit, constructed from a heat-resistant material, which is air cooled. Cooling water and air are supplied to and circulated through the suit by conduits wrapped in insulating material which can easily be dragged along the floor of the oven by the repairman. The suit, in use, weights approximately 60 pounds and enables a worker to work in the hostile environment for extended periods when performing such tasks as sawing or chipping out damaged brick or cleaning the heating flues. The other suit is air cooled only and employed when the workers are performing tasks which permit them to move into and out of the oven at short intervals such as when installing heat insulating tiles on the oven wall or when installing brick in the repair area. The air cooled suit enables a worker to safely remain in he hostile atmosphere for work periods of 15 to 20 minutes. A glass fiber reinforced insulating sleeve 78 may be employed to encase and protect the hoses used to supply air or air and water to the hot suit. Hoses and power cables employed with the power tools are capable of withstanding the temperatures encountered. After such a work period in the oven, approximately 5 minutes of rest in ambient air on the work platform permits the cooling system to remove any excess heat so that the worker can return for another work period. The double suit construction and circulating cooling fluid system provides a completely safe environment for the worker for substantially longer work periods.

While we have disclosed and described preferred embodiments of our invention, we wish it understood that we do not intend to be restricted solely thereto, but rather that we do intend to include all embodiments thereof which would be apparent to one skilled in the art and which come within the spirit and scope of our invention.

We claim:

1. A method of repairing a damaged internal surface portion of a wall of a normally closed chamber, the wall being constructed of refractory brick joined by a heat resistant mortar and normally being maintained at an operating temperature of at least 2000° F., the method comprising the steps of initially opening the chamber and cooling the wall to be repaired to a temperature internally of the wall below about 1900° F. and to a surface temperature in the area to be repaired of no less than about 500° F. and maintaining the temperature of the wall within this range throughout the repair, entering the chamber and removing the damaged brick defining the internal surface portion requiring repair, manually rebuilding the portion of the wall from within the chamber by replacing the removed brick with new brick utilizing a high temperature resistant mortar, the new brick having a coefficient of thermal expansion compatible with the existing brick in the wall upon reheating the wall from such cooled temperature to its normal operating temperature, and closing the chamber and reheating the refractory wall to its normal operating temperature.

2. The method defined in claim 1 wherein the internal temperature of the wall being repaired is maintained within the range of about 1500° F. to about 1900° F. throughout the repair operation.

3. The method defined in claim 1 wherein normally closed chamber has door means capable of being removed to expose the interior of the chamber to atmosphere, and wherein the step of initially cooling the wall comprises opening said chamber and exposing the interior thereof to the atmosphere until the surface of the wall to be repaired is cooled to no less than about 500° F. and the internal temperature of the wall is cooled to no less than 1500° F.

4. The method defined in claim 3 wherein the damaged brick are manually removed by workmen entering the chamber wearing heat insulating protective clothing capable of enabling the workmen to safely come into contact with the wall being repaired.

5. The method defined in claim 4 further comprising the step of continuously supplying cooling fluid to the protective clothing while the workmen are in the chamber.

6. The method defined in claim 4 wherein the step of removing the damaged brick comprises initially sawing around the damaged area along horizontal lines above and below the area to be repaired and along vertical lines at the ends of the area to be repaired, and thereafter removing the brick from the damaged area using power driven tools to chip the damaged brick from the wall.

7. The method defined in claim 3 wherein said wall is a wall of a coke oven having internal flues therein for heating the oven, and wherein heat is applied to the wall under repair through the flues in the area of the wall not being repaired to maintain the temperature of the wall within the stated range during the repair operation.

8. The method defined in claim 3 wherein the wall to be repaired is constructed from refractory silica brick and wherein the brick used to repair the wall are molded from a castable refractory material having a coefficient of thermal expansion compatable with said silica brick when the repaired wall is heated from the reduced temperature to its normal operating temperature.

9. A method of repairing a damaged coke oven liner wall which is constructed of refractory brick joined by a heat resistant mortar, the wall having a plurality of heating flues formed therein and normally being maintained at an operating temperature of at least 2000° F., the method comprising the steps of initially cooling the wall to a temperature in the heating flues to within the range of about 1500° F. to about 1900° F. and a temperature at the surface to be repaired of no less than about 500° F., maintaining the wall at said cooled temperatures throughout the repair, entering the oven and removing the damaged brick from the area of the wall requiring repair, manually replacing the removed brick with new brick utilizing a high temperature resistant mortar, the new brick having a coefficient of thermal expansion compatable with existing brick in the wall upon reheating the wall to its normal operating temperature, and reheating the refractory wall to its normal operatting temperature upon completion of the repair.

10. The method defined in claim 9 wherein the step of initially cooling the wall comprises removing the coke oven doors to expose the interior of the oven to the atmosphere until the repair is completed.

11. The method as defined in claim 10 wherein the damaged brick are removed and new brick installed by workmen entering the chamber wearing heat insulating protective clothing capable of enabling the workmen to safely come into contact with the wall being repaired.

12. The method defined in claim 11 further comprising the step of continuously supplying cooling fluid to the protective clothing while the workmen are in the chamber.

13. The method defined in claim 11 wherein said new brick are at ambient temperature when installed in the wall.

14. The method defined in claim 13 wherein said new brick are molded from a castable refractory material.

15. The method defined in claim 11 wherein said new brick are preheated to a first temperature of at least about 2000° F. and then cooled to a second temperature of at least about 1000° F. and installed in the wall while at the second temperature.

16. The method defined in claim 11 further comprising the step of positioning a heat insulating ocvering over at least a portion of the wall of the coke oven opposite to the wall being repaired prior to commencing removal of the damaged brick.

17. The method defined in claim 16 wherein said heat insulating covering comprises a plurality or rigid sheets of heat insulating material, and wherein the step of positioning the heat insulating covering comprises adhesively bonding said sheets directly to the surface of the coke oven wall in areas thereof which may be contacted by the heat protective clothing worn by workers in the oven.

18. The method defined in claim 17 further comprising applying said rigid sheets to at least portions of both liner walls of the oven in areas thereof not requiring repair.

19. The method defined in claim 16 wherein the step of positioning said heat insulating covering comprises extending a cable through the oven and securing the ends of the cable outside the oven, and supporting a flexible sheet of heat insulating material from the cable.

20. The method as defined in claim 11 wherein the step of removing damaged brick comprises initially sawing around the damaged area through the liner wall and into the flues along horizontal and vertical lines and thereafter removing the brick from the damaged area of the wall.

21. The method as defined in claim 20 further comprising cleaning any brick, mortar or other debris from the flues immediately behing the wall portion which has been removed before installing the new brick.

22. The method as defined in claim 20 further comprising the step of stopping the flow of fuel gas to the flues in the wall of the oven only in the area to be repaired prior to commencing the removal of the damaged brick, and maintaining the flow of fuel gas to the remaining flues in said walls at a rate lower than required in a normal coking operation to maintain the wall temperature within the stated range until the repair is completed.

23. The method defined in claim 22 further comprising the step of continuously supplying cooling fluid to the protective clothing while the workmen are in the chamber.

24. The method defined in claim 23 wherein said new brick are at ambient temperature when installed in the wall.

25. The method defined in claim 24 further comprising the step of positioning a heat insulating covering over at least a portion of the wall of the coke oven opposite to the wall being repaired prior to commencing removal of the damaged brick.

26. The method defined in claim 25 wherein said heat insulating covering comprises a plurality or rigid sheets of heat insulating material, and wherein the step of positioning the heat insulating covering comprises adhesively bonding said sheets directly to the surface of the coke oven wall in areas thereof which may be contacted by the heat protective clothing worn by workers in the oven.

27. The method defined in claim 23 wherein said new brick are preheated to a first temperature of at least about 2000° F. and then cooled to a second temperature of at least about 1000° F. and installed in the wall while at the second temperature.

28. A method of repairing a damaged internal surface portion of a wall of a nomally closed chamber constructed of refractory brick joined by a heat resistant mortar, the wall normally being maintained at an operating temperature of at least 2000° F., the method comprising the steps of initially opening the chamber and cooling the wall to be repaired to a temperature level substantially below its normal operating temperature but not below the temperature at which substantial thermal contraction takes place and maintaining the temperature of the wall at this reduced temperature throughout the repair, entering the chamber and removing damaged brick from the area of the wall requiring repair, manually replacing the removed brick with new brick utilizing a high temperature resistant mortar, the new brick having a coefficient of thermal expansion compatable with the existing brick in the wall upon reheating the wall from such cooled temperature to its normal operating temperature.

* * * * *